US009548044B2

(12) United States Patent
Chekardzhikov

(10) Patent No.: US 9,548,044 B2
(45) Date of Patent: Jan. 17, 2017

(54) VIBRATION-SENSING MUSIC INSTRUMENT MOUNTABLE DEVICE

(71) Applicant: Petar Chekardzhikov, Fullerton, CA (US)

(72) Inventor: Petar Chekardzhikov, Fullerton, CA (US)

( * ) Notice: Subject to any disclaimer, the term of this patent is extended or adjusted under 35 U.S.C. 154(b) by 37 days.

(21) Appl. No.: 14/559,635

(22) Filed: Dec. 3, 2014

(65) Prior Publication Data

US 2015/0082970 A1 Mar. 26, 2015

Related U.S. Application Data

(63) Continuation-in-part of application No. 13/692,870, filed on Dec. 3, 2012, now Pat. No. 9,240,170.

(60) Provisional application No. 61/911,390, filed on Dec. 3, 2013.

(51) Int. Cl.

| | |
|---|---|
| ***G10G 7/02*** | (2006.01) |
| ***G10G 7/00*** | (2006.01) |
| ***G10D 3/14*** | (2006.01) |
| ***G10H 1/44*** | (2006.01) |
| ***G10D 9/00*** | (2006.01) |

(52) U.S. Cl.

CPC *G10G 7/02* (2013.01); *G10D 3/14* (2013.01); *G10D 9/00* (2013.01); *G10G 7/00* (2013.01); *G10H 1/44* (2013.01)

(58) Field of Classification Search

CPC ..... G10G 7/02; G10G 7/00; G10D 9/00; G10D 3/14; G10H 1/44

USPC ..... 84/453, 454, 455

See application file for complete search history.

(56) References Cited

U.S. PATENT DOCUMENTS

| | | | | | |
|---|---|---|---|---|---|
| 3,496,297 | A | * | 2/1970 | Brumberger | G10H 3/146 248/362 |
| 4,365,537 | A | * | 12/1982 | Pogoda | G10D 3/163 84/320 |
| 4,569,077 | A | * | 2/1986 | Marinelli | G10K 11/004 310/328 |
| 4,721,276 | A | * | 1/1988 | Moss | B60N 3/10 248/205.2 |
| 4,899,636 | A | * | 2/1990 | Chiba | B06B 1/06 381/114 |
| 5,388,496 | A | * | 2/1995 | Miller | G10G 7/02 324/76.11 |
| D378,683 | S | * | 4/1997 | Ridinger | D10/102 |
| 5,631,426 | A | * | 5/1997 | Jao | G01H 1/00 73/587 |
| 5,637,820 | A | * | 6/1997 | Wittman | G10D 1/085 84/327 |

(Continued)

*Primary Examiner* — David Warren
*Assistant Examiner* — Christina Schreiber
(74) *Attorney, Agent, or Firm* — Superior IP, PLLC; Dustin L. Call

(57) ABSTRACT

A music instrument mountable device. The music instrument mountable device includes a vibration sensing device configured to detect a note being played on a music instrument. The music instrument mountable device also includes an attachment. The attachment includes a magnet configured to releasably secure the vibration sensing device to the music instrument. The attachment also includes a ferromagnetic attachment configured to attach to the music instrument. The magnet and the ferromagnetic attachment are configured to magnetically connect the vibration sensing mountable device to the music instrument.

20 Claims, 5 Drawing Sheets

(56) References Cited

U.S. PATENT DOCUMENTS 5,728,959 A * 3/1998 O'Rorke ..... G10G 7/02 248/205.2
5,877,444 A * 3/1999 Hine ..... G10G 7/02 84/454
6,291,755 B1 * 9/2001 Hine ..... G10G 7/02 84/454
6,465,723 B2 * 10/2002 Milano ..... G10G 7/02 84/274
6,797,872 B1 * 9/2004 Catalano ..... G10G 7/02 84/453
6,923,063 B2 * 8/2005 Komninos ..... G01N 29/14 73/587
6,965,067 B2 * 11/2005 Kondo ..... G10G 7/02 84/454
7,049,502 B2 * 5/2006 Taku ..... G10G 7/02 84/454
7,074,998 B2 * 7/2006 Hurwicz ..... G10G 7/02 84/454
7,265,282 B2 * 9/2007 Membreno ..... G10G 7/02 84/453
7,285,710 B1 * 10/2007 Wallace ..... G10G 7/02 84/454
7,390,951 B2 * 6/2008 Dulaney ..... G10G 7/02 84/454
7,709,720 B1 * 5/2010 Shippey ..... G10D 3/00 84/327
7,818,078 B2 * 10/2010 Iriarte ..... G10H 1/0083 700/94
7,875,784 B2 * 1/2011 Moyle ..... G10G 7/02 84/329
7,960,636 B2 * 6/2011 Demsey ..... G10H 1/40 84/455
8,173,881 B1 * 5/2012 Schenk ..... G10D 1/005 84/312 R
8,334,449 B2 * 12/2012 Nielsen ..... G10G 7/02 84/454
9,240,170 B2 * 1/2016 Chekardzhikov ..... G10G 7/02
9,286,872 B2 * 3/2016 Packouz ..... G10H 3/186
9,424,824 B2 * 8/2016 Webman ..... G10H 3/18
2003/0169377 A1 * 9/2003 Kulas ..... G10G 7/02 349/1
2007/0006716 A1 * 1/2007 Salmond ..... G10G 7/02 84/600
2012/0067192 A1 * 3/2012 Nielsen ..... G10G 7/02 84/454
2013/0074677 A1 * 3/2013 D'Addario ..... G10D 3/14 84/455
2015/0082970 A1 * 3/2015 Chekardzhikov ..... G10G 7/02 84/455

* cited by examiner

VIBRATION-SENSING MUSIC INSTRUMENT MOUNTABLE DEVICE

CROSS-REFERENCE TO RELATED APPLICATIONS

This application claims the benefit of and priority to U.S. Provisional Patent Application Ser. No. 61,911,390 filed on Dec. 3, 2013, which application is incorporated herein by reference in its entirety.

This application is a continuation-in-part of, and claims the benefit of and priority to, U.S. Non-Provisional patent application Ser. No. 13/692,870 filed on Dec. 3, 2012, which application is incorporated herein by reference in its entirety.

BACKGROUND OF THE INVENTION

Digital tuners allow user to easily tune music instruments, such as guitars. In particular, the digital tuner can provide an easy to understand display which allows the user to quickly determine the note being played and tune the music instrument so that the note produced is the note intended by the user.

However, these digital tuners suffer from a number of drawbacks. For example, they must be close to the music instrument in order to produce an accurate reading. If it is not sufficiently close, then the digital tuner will be unable to measure the note properly and tuning the music instrument will become difficult or impossible. However, this means that either the user is holding the tuner or balancing it closely to the music instrument. Neither is desirable because neither replicates normal play positions by the user.

Some users clip the digital tuner to the headstock on the music instrument to ensure proximity. However, this is often a temporary solution at best as the clip must be removed before transport. In addition, the clip and tuner are visible to the audience so it is not aesthetically pleasing to leave on during a performance. Further, the clip can damage the finish of the music instrument while being used, placed or removed. Finally, the clip can cause an undesired "buzz" if it vibrates relative to the surface of the music instrument.

Accordingly, there is a need in the art for a system that can attach a digital tuner to an instrument at locations other than the headstock. Additionally, there is a need in the art for the system to be capable of attachment for long periods of time, such as during transportation of the instrument. Further, there is a need in the art for the system to accurately transfer vibration to the tuner. Moreover, there is a need in the art for a system that can attach inconspicuously to the instrument, so that it is not obtrusive and distracting for the audience during a performance. Also, there is a need in the art for a system that would attach to instruments where a clip cannot be attached.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a music instrument mountable device. The music instrument mountable device includes a vibration sensing device configured to detect a note being played on a music instrument. The music instrument mountable device also includes an attachment. The attachment includes a magnet configured to releasably secure the vibration sensing device to the music instrument. The attachment also includes a ferromagnetic attachment configured to attach to the music instrument. The magnet and the ferromagnetic attachment are configured to magnetically connect the vibration sensing mountable device to the music instrument.

Another example embodiment includes a music instrument mountable device. The music instrument mountable device includes a vibration sensing device configured to detect a note being played on a music instrument. The music instrument mountable device also includes an attachment. The attachment includes a magnet configured to releasably secure the vibration sensing device to the music instrument. The attachment also includes a ferromagnetic attachment configured to permanently attach to the music instrument. The attachment further includes a swivel configured to allow the orientation of the vibration sensing device to be changed relative to the music instrument, attach to the vibration sensing device attach to the music instrument.

Another example embodiment includes a music instrument mountable device. The music instrument mountable device includes a musical instrument. The music instrument mountable device also includes a vibration sensing device configured to detect a note being played on a music instrument. The music instrument mountable device further includes an attachment. The attachment includes a magnet releasably securing the vibration sensing device to the music instrument. The attachment also includes a ferromagnetic attachment permanently attached to the music instrument. The attachment further includes a swivel configured to allow the orientation of the vibration sensing device to be changed relative to the music instrument, attach to the vibration sensing device attach to the music instrument.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations.

It is understood that the figures are diagrammatic and schematic representations of some embodiments of the invention, and are not limiting of the present invention, nor are they necessarily drawn to scale.

Figure 1:
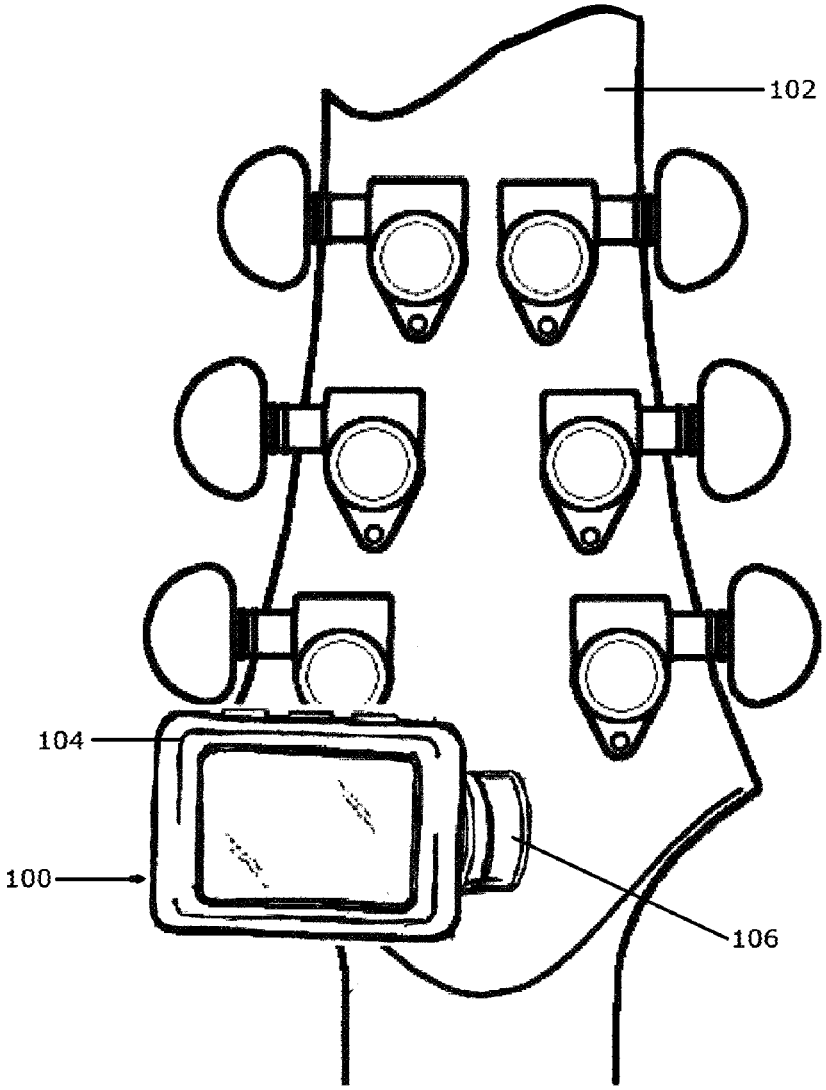
FIG. 1 illustrates an example of a music instrument mountable tuner.

FIG. 1 illustrates an example of a music instrument mountable tuner 100. The music instrument mountable tuner 100 can attach to any desired location during use. For example, the music instrument mountable tuner 100 can attach to the headstock 102, the soundboard, on the side next to the heel, directly on the tuning machines of a music instrument, or any other desired location. Additionally or alternatively, the music instrument mountable tuner 100 can be left in place during use. I.e., the attachment strength can be sufficient that the music instrument mountable tuner 100 need not be removed during use of the instrument.

FIG. 1 shows that the music instrument mountable tuner 100 can be attached to a music instrument 102. For example, the music instrument mountable tuner 100 can be attached to a guitar, sitar, rabab, electric bass, violin, viola, cello, double bass, banjo, mandolin, ukulele, bouzouki, harp, trumpet, trombone, tuba or any other desired music instrument. E.g., a guitar is a plucked string instrument, played either with fingers or a pick. The guitar includes of a body with a rigid neck to which the strings, generally six in number but sometimes more or less, are attached. The guitar can be constructed of various woods and strung with animal gut or with either nylon or steel strings. As used herein, the guitar can include both acoustic and electric guitars.

FIG. 1 shows that the music instrument mountable tuner 100 can include a digital tuner 104. The digital tuner 104 can detect the vibrations from the music instrument 102 and determine the note played by the music instrument 102. I.e., the digital tuner 102 can display the note played by the music instrument, allowing a user to adjust the music instrument 102 to be properly tuned. For example, the digital tuner 104 can include a backlit color LCD display or touchscreen display. Additionally or alternatively, the digital tuner 104 can include a piezoelectric sensor. A piezoelectric sensor is a device that uses the piezoelectric effect to measure pressure, acceleration, strain or force by converting them to an electrical charge. This can be converted to a frequency or note being played and/or can be amplified during play.

FIG. 1 also shows that the music instrument mountable tuner 100 can include an attachment 106. The attachment 106 can be configured to attach the digital tuner 104 to the music instrument 102. Attaching the digital tuner 104 to the music instrument 102 can allow the digital tuner 104 to more accurately detect the correct note played by the music instrument 102. Additionally or alternatively, the attachment 106 can ensure that the digital tuner 104 is available to the user when desired. I.e., the attachment 106 can allow the digital tuner 104 to be moved with the music instrument 102.

Figure 2:
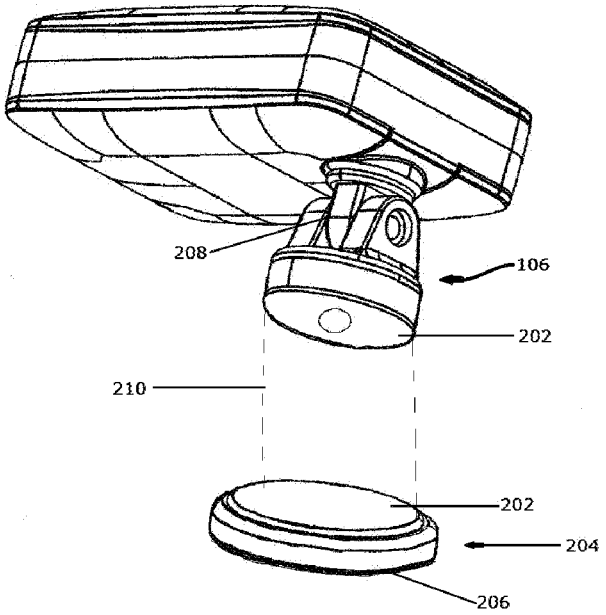
FIG. 2 illustrates an example of tuner with magnetic attachments.

FIG. 2 illustrates an example of an attachment 106. The attachment 106 can releasably attach a digital tuner to a music instrument. In particular, the attachment 106 can allow a user to place a digital tuner near the music instrument in any desired location. For example, the attachment can allow the music instrument mountable tuner behind the headstock of a guitar, completely concealing it from the audience. The attachment 106 can be of sufficient strength to ensure that the digital tuner remains in place during use or transport of the music instrument.

FIG. 2 shows that the attachment 106 can include a magnet 202. The magnet 202 is a material or an object that produces a magnetic field which attracts ferromagnetic materials such as iron, nickel cobalt, and other rare earth metals. It also attracts or repels other magnets. The magnet 202 is a permanent magnet that creates its own persistent magnetic field. The magnet should have sufficient pulling force to keep the music instrument mountable tuner attached to the instrument. An example of a strong magnet is rare earth magnet also known as neodymium magnet. A neodymium magnet (also known as NdFeB, NIB or Neo magnet) is a permanent magnet made from an alloy of neodymium, iron, and boron to form the $Nd_2Fe_{14}B$ tetragonal crystalline structure. Neodymium magnets are the strongest type of permanent magnets commercially available. The biggest advantage of neodymium magnets is that they can be made in a very small size and still provide sufficient pulling force compared to other more common magnets. One with skill in the art will appreciate the fact that the use of neodymium magnet allows the attachment to be very small, so that the user can mount the device virtually anywhere on the music instrument, where no other form of known attachment is possible.

FIG. 2 also shows a ferromagnetic attachment 204, that can be permanently or releasably attached to a music instrument where no ferromagnetic metal is present or available. The ferromagnetic attachment 204 can include ferromagnetic metal such as, iron, nickel or another magnet 202 and a casing 206 with a double-sided adhesive sticker or a sticky gel pad attached. The adhesive sticker allows the user to attach the ferromagnetic attachment 204 permanently to any desired location on the music instrument and is smaller than the sticky gel pad. The sticky gel pad is reusable but is larger than the double-sided adhesive sticker. For example, the sticky gel pad could be approximately 20 mm×30 mm but the adhesive sticker can be as small as the magnet (or smaller). When the ferromagnetic attachment 204 and the magnet 202 are in close proximity the magnetic field properties of the two components attach together, creating a connection between the ferromagnetic attachment 204 and the magnet 202. To detach the ferromagnetic attachment 204 and the magnet 202, the user needs only to lift or slide off the magnet 202 from the ferromagnetic attachment 204.

One of skill in the art will appreciate the ability to mount tuner 100 to any desired location of the music instrument via use of the ferromagnetic attachment 204. I.e., the ferromagnetic attachment 204 can be very small, so it can be placed nearly anywhere on a music instrument. For example, it can be attached to a location where the tuner is not intrusive, obstructive and completely unnoticeable by the audience. For example, If attachment 204 is attached on the backside of a headstock, then the mountable device can be completely hidden from view of the audience.

One of skill in the art will appreciate that the magnet 202 can allow an efficient transfer of vibrations from the music instrument to the digital tuner 104. In particular, as the magnet 202 is attached to the music instrument directly or via ferromagnetic attachment 204, the connection created by the magnetic field allows the digital tuner 104 to pick up the vibrations easily and be quite sensitive.

One of skill in the art will appreciate that the efficiency of the transfer can be enhanced by the magnet 202 with a small diameter. For example, magnet 202 can be circular with an outside diameter between 8 mm and 25 mm. In particular, the magnet 202 can be circular ring with a diameter of approximately 12.5 mm. As used in the specification and the claims, the term approximately shall mean that the value is within 10% of the stated value, unless otherwise specified.

FIG. 2 further shows that the magnet 202 and the ferromagnetic attachment 204 may have the same diameter. Attached together, the magnet 202 and the ferromagnetic attachment 204 create swivel 210, allowing the music instrument mountable tuner 100 to be rotated by the user to adjust the viewing angle of the display. The swivel 210 can allow the orientation of the digital tuner to be changed without having to release magnet 202.

One in the skill of art would appreciate that attachment 204 can alternatively be mounted permanently on the inside of some music instruments. For example, ferromagnetic attachment 204 can be permanently mounted inside an acoustic guitar. Because of the strong magnetic properties of neodymium magnets they are strongly attracted even with another surface in between the two magnets. Such setup makes attachment 204 completely invisible to the user and the audience.

Figure 3:
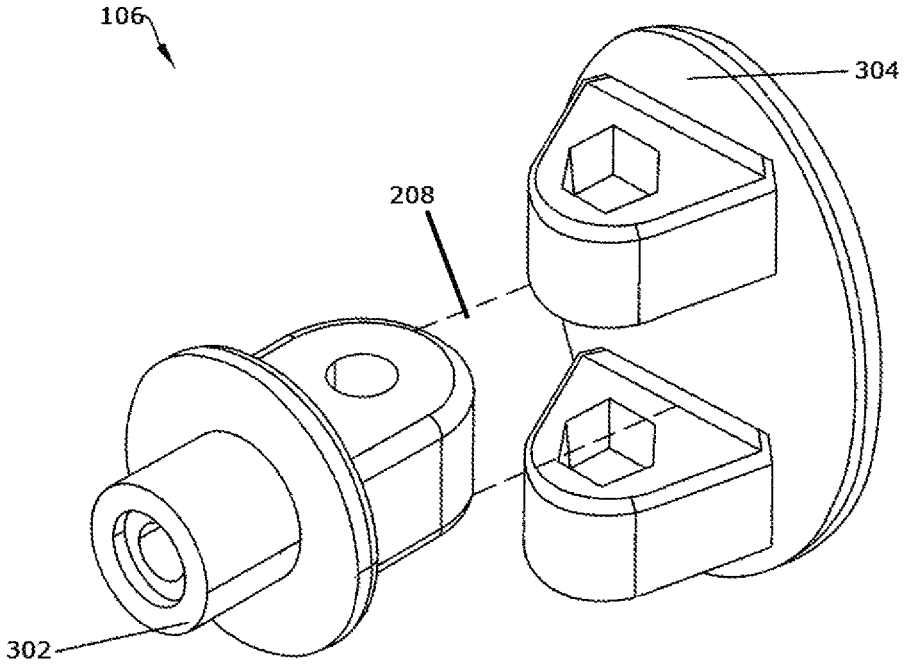
FIG. 3 illustrates an exploded view of an example of a swivel.

FIG. 3 illustrates an exploded view of an example of an attachment 106. Attachment 106 can include a first attachment 302. The first attachment 302 can be configured to attach to the digital tuner. Additionally or alternatively, the first attachment 302 can work as a swivel to allow the digital tuner to move 360 degrees relative to the attachment 106.

FIG. 3 also shows that the attachment 106 can include a second attachment 304. The second attachment 304 contains magnet 202. Additionally or alternatively, the second attachment 304 together with magnet 202 can allow attachment 106 to move relative to attachment 204 as a swivel 210.

In addition, the first attachment 302 and the second attachment 304 can be connected to one another to act as a hinge 208. The hinge 208 can allow the digital tuner to tilt up and down relative to the music instrument. In particular, the hinge 208 can allow the orientation of the digital tuner to be adjusted. For example, the user can change the position of the digital tuner during tuning and then place the digital tuner in a more compact form when not in use. Additionally or alternatively, the attachment 106 can allow the digital tuner to be placed in multiple orientations for a better viewing angle. I.e., the first attachment 302 can rotate relative to the digital tuner and the second attachment 304 can rotate relative to the ferromagnetic attachment 204. In addition, the hinge connection of the first attachment 302 and the second attachment 304 can allow the tuner to tilt in a third direction relative to the second attachment 304.

Alternatively, the attachment 106 can include a ball joint or other rotatable mechanism which can allow movement of tuner 100 relative to music instrument. The ball joint can include any ball joint configured to allow reorientation of the digital tuner 104. For example, the ball joint can include a tension mounted ball joint. Additionally, the ball joint can include a magnetic ball joint. Alternatively, the ball joint can be spring loaded.

Figure 4:
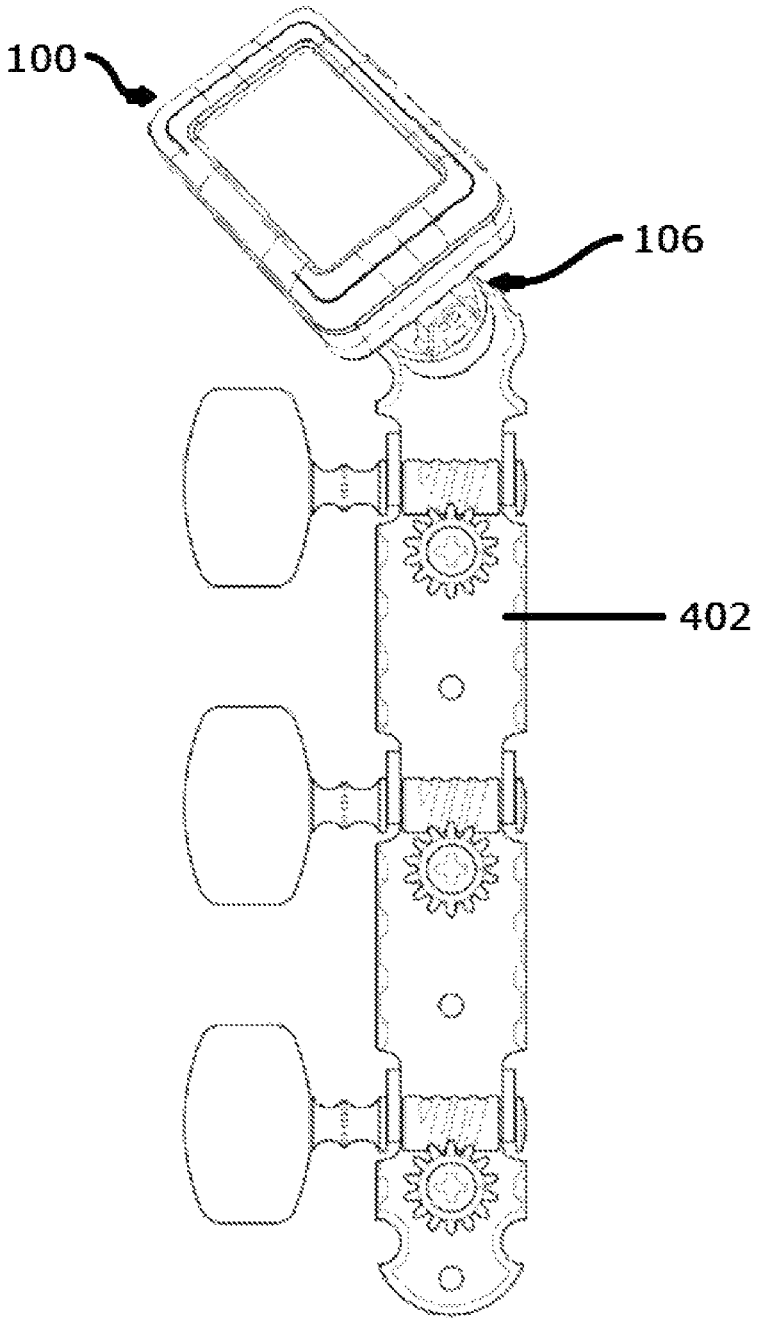
FIG. 4 illustrates an alternative example of an attachment to a metal tuning machine head of a music instrument.

FIG. 4 illustrates an example of tuner 100, and attachment 106 directly attached to the tuning machines 402 of a guitar. Magnet 202 can be attached directly to any ferromagnetic metal that is present on the music instrument. In such instances there is no need of attachment 204. Examples of such are the tuning machines 402 of many stringed instruments, guitar strap pins, metal bridges and others ferromagnetic parts of many music instruments.

Also, neodymium magnets can be used in conjunction with a clamp, clip or any other string instrument mounting device. A small magnet 202 can be installed at the point where the tuner attaches to the mounting device. For example a small magnet 202 can replace the swivel of a clip (since the magnetic attachment can potentially rotate). Using an attachment 106 attached to the tuner allows the tuner to be easily and quickly attached and detached from the music instrument via attachment 106, without necessarily removing the whole assembly.

One in the skill of art will appreciate that attachment 106 can directly attach to a guitar strap pin. A guitar strap pin is a device that is usually bolted to the side of the guitar and is used to attach a strap. The strap allows the performer to play the instrument standing up. In addition, a guitar strap pin can be designed to include attachment similar to attachment 204 to provide a strong and reliable connection between mountable tuner 100 and the music instrument.

Figure 5:
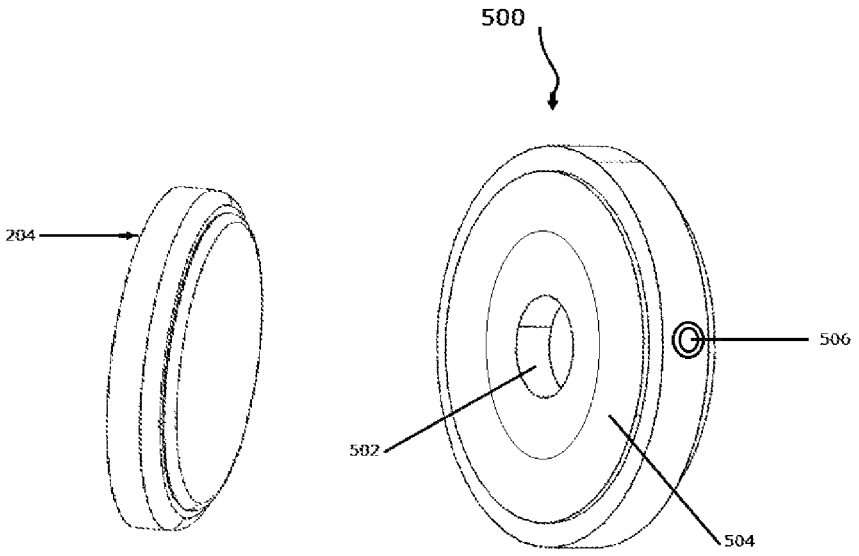
FIG. 5 illustrates an example of a music instrument mountable pickup.

FIG. 5 illustrates an example of a music instrument mountable pickup 500. A music instrument mountable pickup 500 is a transducer that captures mechanical vibrations and converts them to an electrical signal that is amplified, recorded, or broadcast. For example, the music instrument mountable pickup 500 can produce an electrical signal which is sent to an amplifier.

FIG. 5 shows that the music instrument mountable pickup 500 can include a sensor 502. The sensor 502 can include any device which is configured to detect vibrations produced by the music instrument. For example, the sensor 502 can include a piezoelectric sensor, a magnetic sensor a microphone or any other desired device configured to detect the vibrations produced by the stringed instrument.

FIG. 5 also shows that the music instrument pickup 500 includes a magnet 504. The magnet 504 can be inside the pickup device. Alternatively, the magnet 504 can be externally attached to the pickup 500. A second magnetic attachment 204 can be permanently attached inside the music instrument. Additionally or alternatively, magnetic attachment 204 can be permanently mounted at any other desired location of the music instrument.

FIG. 5 also shows that the music instrument mountable pickup 500 can include a jack 506. The jack 506 can be configured to allow an electrical connection between the music instrument mountable pickup 500 and an external device. For example, the jack 506 can allow a wire or other connector to be connected to the music instrument mountable pickup 500. Additionally, pickup 500 can be connected wirelessly to an external device. An example of wireless connection is a bluetooth connection. The external device can include an amplifier, headphones, mobile device, recording devices or any other desired device.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A music instrument mountable device, the music instrument mountable device comprising:

a vibration sensing device configured to detect a note being played on a music instrument; and an attachment including:

a magnet, wherein the magnet is:

attached to the vibration sensing device; and configured to releasably secure the vibration sensing device to the music instrument; and a ferromagnetic attachment configured to releasably attach to the music instrument;

wherein the magnet and the ferromagnetic attachment are configured to magnetically and releasably connect to one another to connect the vibration sensing mountable device to the music instrument.

2. The music instrument mountable device of claim 1, wherein the vibration sensing device includes a transducer.

3. The music instrument mountable device of claim 2, wherein the transducer includes a jack.

4. The music instrument mountable device of claim 1, wherein the ferromagnetic attachment includes a suction device configured to secure the ferromagnetic attachment to the music instrument.

5. The music instrument mountable device of claim 1, wherein the ferromagnetic attachment includes a clip configured to secure the ferromagnetic attachment to the music instrument.

6. The music instrument mountable device of claim 1, wherein the vibration sensing device includes a digital tuner.

7. The music instrument mountable device of claim 1, wherein the ferromagnetic attachment includes a double-sided adhesive sticker configured to attach the ferromagnetic attachment to the music instrument.

8. The music instrument mountable device of claim 1, wherein the ferromagnetic attachment includes a sticky gel pad configured to attach the ferromagnetic attachment to the music instrument.

9. The music instrument mountable device of claim 1, wherein the attachment includes a ball joint configured to allow the orientation of the vibration-sensing device to be changed relative to the music instrument.

10. The music instrument mountable device of claim 9, wherein the ball joint includes a tension mounted ball joint.

11. The music instrument mountable device of claim 9, wherein the ball joint includes a magnetic ball joint.

12. A music instrument mountable device, the music instrument mountable device comprising:

a vibration sensing device configured to detect a note being played on a music instrument; and an attachment including:

a magnet, wherein the magnet:

is attached to the vibration sensing device; and configured to releasably secure the vibration sensing device to the music instrument;

a ferromagnetic attachment configured to magnetically and releasably attach to the magnet; and releasably attach to the music instrument;

a swivel, wherein the swivel is:

attached to the magnet; and configured to:

allow the orientation of the vibration sensing device to be changed relative to the music instrument;

attach to the vibration sensing device; and attach to the music instrument.

13. The music instrument mountable device of claim 12, wherein the magnet is a neodymium magnet.

14. The music instrument mountable device of claim 12, wherein the ferromagnetic attachment is configured to attach to the inside of the music instrument.

15. A music instrument mountable device, the music instrument mountable device comprising:

a musical instrument;

a vibration sensing device configured to detect a note being played on the music instrument; and an attachment including:

a magnet, wherein the magnet:

is attached to the vibration sensing device; and releasably secures the vibration sensing device to the music instrument;

a ferromagnetic attachment releasably attached to the music instrument, wherein the ferromagnetic attachment:

magnetically and releasably attaches to the magnet;

a swivel configured to:

allow the orientation of the vibration sensing device to be changed relative to the music instrument;

attach to the vibration sensing device; and attach to the music instrument.

16. The music instrument mountable device of claim 15, wherein the vibration sensing device includes a piezoelectric sensor.

17. The music instrument mountable device of claim 15 attached to the soundboard of the music instrument.

18. The music instrument mountable device of claim 15 attached to the sides of the music instrument.

19. The music instrument mountable device of claim 15 attached to the headstock of the music instrument.

20. The music instrument mountable device of claim 15 attached to a tuning mechanism of the music instrument.

* * * * *